US006326873B1

(12) United States Patent
Faria

(10) Patent No.: US 6,326,873 B1
(45) Date of Patent: Dec. 4, 2001

(54) ELECTROMAGNETIC VALVE DRIVE MECHANISM

(75) Inventor: Christof Faria, Erlangen (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/743,102

(22) PCT Filed: Jun. 26, 1999

(86) PCT No.: PCT/EP99/04452

§ 371 Date: Dec. 28, 2000

§ 102(e) Date: Dec. 28, 2000

(87) PCT Pub. No.: WO00/04281

PCT Pub. Date: Jan. 27, 2000

(30) Foreign Application Priority Data

Jul. 14, 1998 (DE) ..... 198 31 520

(51) Int. Cl.[7] ..... H01F 3/00

(52) U.S. Cl. ..... 335/251; 335/255; 335/257; 251/129.01; 123/90.11

(58) Field of Search ..... 335/251, 255, 335/257, 260; 251/129.01–129.15; 123/90.11

(56) References Cited

U.S. PATENT DOCUMENTS

| | | | | |
|---|---|---|---|---|
| 5,787,858 | * | 8/1998 | Meneely | 122/321 |
| 6,067,946 | * | 5/2000 | Bunker et al. | 123/90.12 |
| 6,076,490 | * | 6/2000 | Esch et al. | 123/90.11 |
| 6,101,992 | * | 8/2000 | Pischinger et al. | 123/90.11 |

* cited by examiner

*Primary Examiner*—Lincoln Donovan
*Assistant Examiner*—Tuyen Nguyen
(74) *Attorney, Agent, or Firm*—Bierman, Muserlian and Lucas

(57) ABSTRACT

An electromagnetic valve drive (1) is proposed comprising a gas exchange valve (2), an actuator rod (3), an armature (4), a closing magnet (5), an opening magnet (6), a closing spring (7) and an opening spring (8). The valve drive (1) comprises means for establishing an equilibrium between the closing and opening springs (7, 8) which equilibrium is determined by symmetric energies of the closing and opening springs (7, 8) at a half stroke of the armature (4). These means are configured as an axially displaceable support (13) for the closing spring (7) on the cylinder head (11) of the internal combustion engine. The support (13) is made, for example, as a hydraulically lifting annular piston (17).

7 Claims, 1 Drawing Sheet

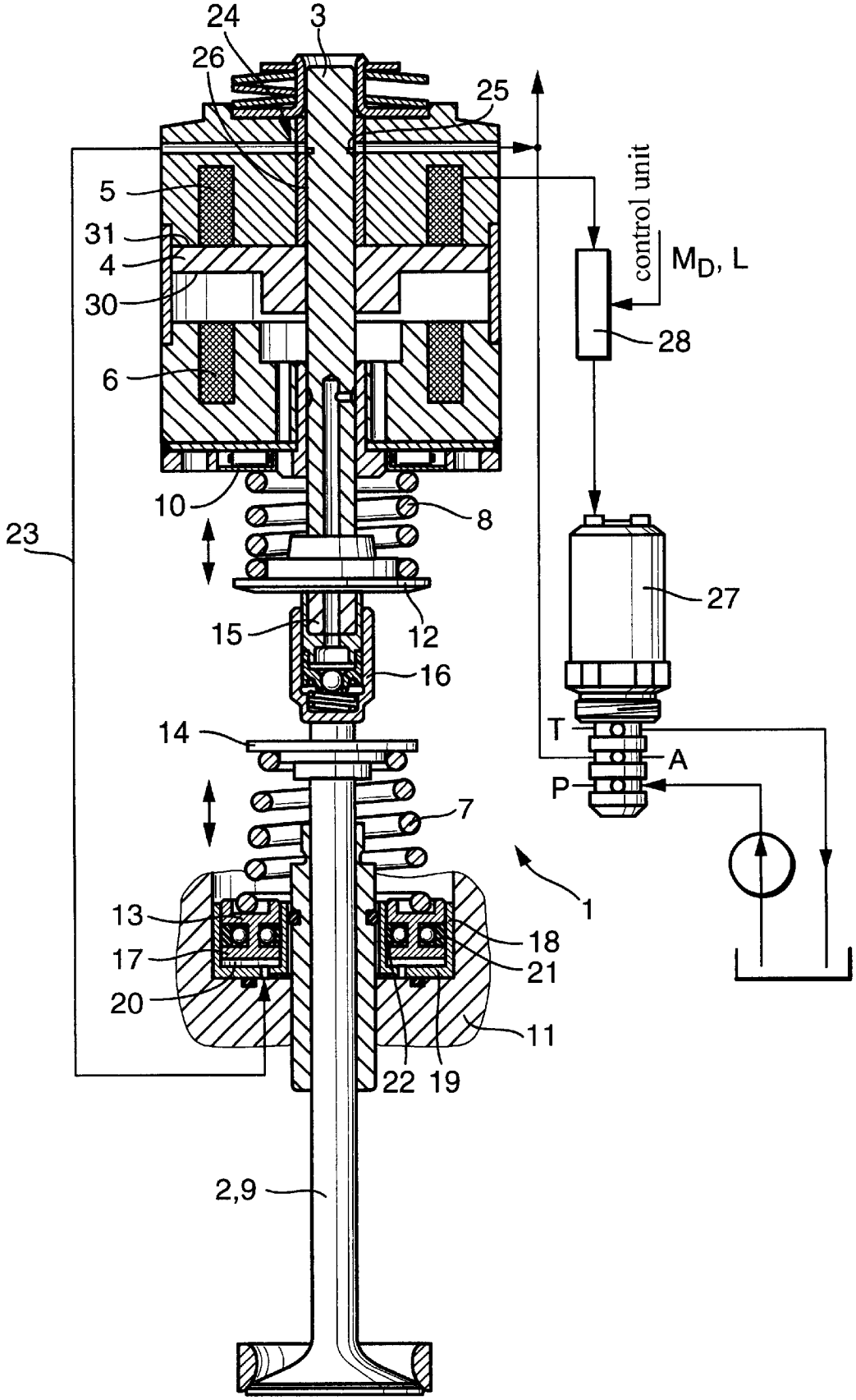
24
3
26
25
5
31
4
30
6
control unit
$M_D$, L
28
10
8
23
27
15
12
16
14
T
A
P
7
1
13
17
20
18
21
11
22
19
2,9

ELECTROMAGNETIC VALVE DRIVE MECHANISM

DESCRIPTION

FIELD OF THE INVENTION

The invention concerns an electromagnetic valve drive that is installed in a cylinder head of an internal combustion engine and has the following features:

a) the valve drive is comprised of a gas exchange valve, an actuator rod, an armature, a closing magnet, an opening magnet, a closing spring and an opening spring, or a plurality of these;

b) the armature is preferably disc-shaped and connected to the actuator rod that acts at one end on the gas exchange valve;

c) the closing magnet is situated opposite a gas exchange valve-distal end face of the armature and the opening magnet is situated opposite a gas exchange valve-proximate end face of the armature, the closing and opening magnets being spaced from each other so that in an end position of the armature on the closing magnet, the gas exchange valve is closed and in an end position of the armature on the opening magnet, the gas exchange valve is open;

d) the closing and opening springs possess at one end a support on the cylinder head and act at another end on the gas exchange valve in opposite directions and at least indirectly through a retainer;

e) in each end position of the armature, one of the springs is pre-stressed so that on alternating energization of the closing and opening magnets, the valve drive functions as an oscillatory spring-mass system; and f) at least one support or one retainer is adjustable in height.

BACKGROUND OF THE INVENTION

DE-PS 39 11 496 describes a generic valve drive of the pre-cited type. In this valve drive, the height of the closing spring can be varied through an eccentric. The variation of the height of the closing spring is intended to vary its resilient force so that the opening period of the gas exchange valve can be influenced.

However, a person of ordinary skill in the art finds no suggestion in the aforesaid document as to how disturbances that can have a negative influence on the oscillatory spring-mass system can be excluded in a simple manner. Such disturbances are mainly gas forces acting on the gas exchange valve and an increasing impact on the valve seat with increasing running time of the internal combustion engine. Installation tolerances can constitute additional disturbances. These can arise, for example, from differing lengths of the springs used but attention must also be paid to differing spring constants. In the most unfavorable case, these disturbances can lead to inoperatability of the oscillatory spring-mass system because the armature can no longer be excited out of its idle position to effect a complete oscillation between its end positions.

OBJECT OF THE INVENTION

The object of the invention is therefore to provide an electromagnetic valve drive of the aforesaid type in which the mentioned drawbacks are eliminated and in which, particularly, the discussed disturbances are excluded by simple measures.

SUMMARY OF THE INVENTION

The invention achieves this object by the features of the characterizing part of the main claim.

According to this claim, the valve drive comprises means for establishing an equilibrium between the closing and opening springs which is determined by symmetric energies of the closing and opening springs at a half stroke of the armature. These equilibrating means are preferably embodied in an axially displaceable support or retainer, and it is preferably the support of the closing spring that is configured for axial displacement.

Due to this equilibration, the energies of the springs are balanced which results in equal impact speeds of the armature in its end positions (on the magnets). A particular advantage of the means of the invention is that the equilibrium is permanently re-adjusted during the operation of the internal combustion engine. By raising or lowering the support of the closing spring, all the disturbances previously mentioned can be eliminated. Only very low levels of energy are required to activate and, in particular, to operate the spring-mass oscillatory system.

Although it is also conceivable to configure the support of the opening spring or the retainers with a variable height, the most appropriate solution is to vary the height of the support, i.e. the base, of the closing spring.

According to a further proposition of the invention, this support is configured as a hydraulically lifting annular piston. However, it is also conceivable to arrange a ball and ramp system or a wedge ramp adjuster in this region. Lifting can also be effected directly through mechanical, magnetic or electromagnetic means.

It is proposed that the closing and opening springs be configured to surround the valve stem and the actuator rod respectively. Advantageously, these springs extend axially outside of the magnets but if required, they can also be integrated in the magnet stack.

According to still another proposition of the invention, the duct for supplying the servo medium to the lifting the annular piston comprises closing means. These closing means permit a lift only when the armature is in abutment with the closing magnet. Further, according to the invention, an annular groove is arranged on the outer peripheral surface of the actuator rod and is aligned to a section of the duct only when the armature is in abutment with the closing magnet. Advantageously, this section of the duct extends through the closing magnet itself.

The supply of the servo medium to the duct is accomplished by an electromagnetic switching valve such as a 3/3 or 3/2 proportional valve. This switching valve can be energized by a control unit. To determine the impact speed of the armature on the closing and opening magnets, the control unit, in its turn, cooperates with measuring means known to a person skilled in the art. Due to the different impact speeds, different current flow paths result in the magnets. These are transmitted as information to the control unit. The torque or the load can optionally serve as further input quantities for the control unit. In this way, disturbances such as gas forces that have an indirect detrimental effect on the oscillatory system can be taken into account.

Advantageously, the retainers for the springs are made in the form of spring plates, known per se. At the same time, the valve drive of this application may comprise a hydraulic clearance compensation element. This reduces all clearances occurring in the valve drive to zero in a phase in which the gas exchange valve is closed. The clearance compensation element is supplied with hydraulic medium in a simple manner axially through the actuator rod.

Due to the fact that the support of the opening spring is made as a thrust bearing, the torques acting in the direction of rotation on the support upon a deflection of the opening spring are eliminated.

According to a final proposition of the invention, the annular piston is sealed relative to the annular recess radially inward and outward by at least one sealing ring. Due to this, only small losses of hydraulic medium are to be expected in this region. The sealing rings are preferably configured so that only low friction occurs between them and the annular gap and, at the same time, the sealing action is adequate.

BRIEF DESCRIPTION OF THE DRAWING

The invention will now be described with reference to the appended drawing. The sole FIGURE shows an electromagnetic valve drive of the invention in a longitudinal section.

DETAILED DESCRIPTION OF THE DRAWING

FIG. 1 discloses an electromagnetic valve drive 1 whose basic structure is known in the technical field. The valve drive 1 comprises a gas exchange valve 2 that is actuated at one end by an actuator rod 3. An armature 4 is rigidly connected to the actuator rod 3. The armature 4, in turn, oscillates between a closing magnet 5 and an opening magnet 6. The gas exchange valve 2 together with the actuator rod 3 and the armature 4 is biased in closing direction by a closing spring 7 and in opening direction by an opening spring 8. Both springs 7, 8 are positioned axially outside of the magnet stack 5, 6 and surround, in this region, a stem 9 of the gas exchange valve 2 and the actuator rod 3 respectively. The opening spring 8 possesses an indirect support 10 on a cylinder head 11 (not further specified) in which the valve drive 1 is installed. In its other direction, the opening spring 8 is supported on a retainer 12 configured as a spring plate.

In its direction opposed to the magnet stack 5, 6, the closing spring 7 is mounted on a hydraulic lifting support 13 that will be more specifically described in the following. In a direction towards the magnet stack 5, 6, the closing spring 7 acts on a spring plate configured as a retainer 14 on the stem 9 of the gas exchange valve 2.

In the region of one of its ends 15, the actuator rod 3 comprises a hydraulic clearance compensation element 16. This reduces all clearances occurring in the valve drive 1 to zero in a phase in which the gas exchange valve 2 is closed.

As mentioned, the support 13 can be lifted hydraulically. It comprises an annular piston 17 that extends in an annular recess 18 of the cylinder head 11. A pressure chamber 20 for hydraulic medium is formed axially between the annular piston 17 and a bottom 19 of the annular recess 18. At the same time, sealing rings 21, 22 are arranged on the outer and inner peripheral surfaces of the annular piston 17. These prevent an undesired leakage of hydraulic medium from the pressure chamber 20 into the open.

The pressure chamber 20 can be pressurized with hydraulic medium coming from a duct 23 which, in the present case, extends diametrically through the closing magnet 5 and is configured in this region as a part of the closing means 24. An annular groove 25 made on the outer peripheral surface 26 of the actuator rod 3 forms a further part of the closing means 24. The annular groove 25 is aligned to the diametrically extending section of the duct 23 only when the armature 4 is in abutment with the closing magnet 5 and the gas exchange valve 2 is thus closed. It is only in this condition that a through-flow is possible and thus also an actuation of the hydraulically lifting support 13.

An electromagnetic switching valve 27, configured in this case, for example, as a 3/3 or a 3/2 proportional valve is arranged upstream of the duct 23. The switching valve 27 operates proportionately to the current and possesses a tank connection T, a pump connection P and only one work connection A for connecting the pump or the tank to the duct 23. Further, a flow into or out of the duct 23 can be completely cut off by the switching valve 27.

The switching valve 27 can be energized by a control unit 28, not more specifically described here. The control unit 28 cooperates with measuring means for determining the impact speed of the armature 4 on the closing or opening magnets 5, 6. The impact speed can be deduced from the flow path of the current upon impact of the armature 4 on the magnets 5, 6. The torque $M_D$ or the load L can be taken as further input quantities for the control unit 28. For instance, under high load, a great amount of fuel is combusted in the cylinder and this can cause relatively large gas forces to act on the gas exchange valve 2 that bring about an undesired change in the force of the closing spring 7.

According to the invention, the valve drive 1 comprises means for establishing an equilibrium between the closing and opening springs 7, 8. This equilibrium is determined by symmetric energies of the closing and opening springs 7, 8 at a half stroke of the armature 4. The means comprise the already mentioned hydraulically lifting support 13. Due to the symmetric energies, an optimal oscillation behavior of the spring-mass oscillatory system is obtained, and only very little energy has to be re-fed into the system to maintain its oscillation ability. If, in the central position of the armature 4, the resultant forces are not nulled but, for example, the energy of the closing spring 7 is higher than that of the opening spring 8, for instance due to the gas forces acting on the gas exchange valve 2, it is possible in the worst case, that the armature 4 no longer reaches its end position on the opening magnet 6 after oscillation excitation. By a variation of the length of the closing spring 7, the initially described drawbacks are eliminated and the aforesaid equilibrium established. In the just mentioned state it is possible, for example, when the armature 4 is in abutment with the closing magnet 5, to energize the switching valve 27 through the control unit 28 so that the tank connection (T) communicates with the duct 23. This leads to a sinking of the annular piston 17 and the support 13. By this, the length of the closing spring 7 is increased and its force reduced.

If, on the other hand, the measuring means detect that the speed of impact of the armature 4 on the opening magnet 6 is higher than on the closing magnet 5, from which it can be followed that at the central position of the armature 4 the total energy of the opening spring 8 is greater than that of the closing spring 7, the support 13 is lifted hydraulically by the annular piston 17 till the aforesaid equilibrium is established. For this, the control unit 28 energizes the switching valve 27 so that the pump connection P and the work connection A on the switching valve 27 are in fluid communication.

It is proposed to use a single switching valve 27 for all the gas exchange valves of the internal combustion engine. However, it is also conceivable to provide a separate switching valve 27 for each gas exchange valve or for a group of gas exchange valves 2.

As already mentioned, a lifting of the support 13 can also be effected by purely mechanical means such as ball and ramp or wedge mechanisms, by a screw system or, for instance, magnetically or directly by electromagnetic means.

It is further provided that the retainer 12 be configured so that its height can be varied and fixed. This can be achieved, for example, by a screw connection to the actuator rod 3 which can be fixed when the height of the retainer 12 has been reached. Thus, with the opening spring 8 in place and prior to the initial ignition of the internal combustion engine, the retainer 12 can be displaced toward the magnet stack 5, 6 till a pre-defined spring force of the opening spring 8 is obtained. The retainer 12 is then connected fixedly to the actuator rod 3. The support 10 is configured as a thrust bearing through which the fixation of the retainer 12 is protected from the torque of the opening spring 8 when the opening spring 8 deflects.

Since, in the shut-off state of the internal combustion engine, the clearance compensation element 16 and the support 13 collapse, measures, not specified here, are provided for pre-filling the clearance compensation element 16 and the pressure chamber 20 with a standard hydraulic medium pressure. This can be done, for example, by the use of a booster pump.

LIST OF REFERENCE NUMERALS AND SYMBOLS

1 valve drive
2 gas exchange valve
3 actuator rod
4 armature
5 closing magnet
6 opening magnet
7 closing spring
8 opening spring
9 stem
10 support
11 cylinder head
12 retainer
13 support
14 retainer
15 end
16 clearance compensation element
17 annular piston
18 annular recess
19 bottom
20 pressure chamber
21 sealing ring
22 sealing ring
23 duct
24 closing means
25 annular groove
26 outer peripheral surface
27 switching valve
28 control unit
29 not used
30 end face
31 end face
T tank connection
P pump connection
A work connection
$M_d$ torque
L load

What is claimed is:

1. An electromagnet valve drive (1) installed in a cylinder head (11) of an internal combustion engine, said valve drive (1) comprising a gas exchange valve (2), an actuator rod (3), an armature (4), a closing magnet (5), an opening magnet (6), a least one closing spring (7), and at least one opening spring (8), the armature (4) being connected to the actuator rod (3) that acts at one end (15) on the gas exchange valve (2), the closing magnet (5) being situated opposite a gas exchange valve-distal end face (31) of the armature (4), the opening magnet (6) being situated opposite a gas exchange valve-proximate end face (30) of the armature (4), the closing and opening springs (7, 8) having at one end a support (13, 10) on the cylinder head (11) and acting at another end through a retainer (14, 12) in opposite directions on the gas exchange valve (2), and only the support (13) of the closing spring (7) being variable in height to create equal energy of the closing and opening spring, wherein the support (13) is made as an annular piston (17) that is capable of being lifted by a hydraulic medium and which, together with the closing spring (7), surrounds a stem (9) of the gas exchange valve (2) while being installed in an annular recess (18) of the cylinder head (11), and a pressure chamber (20) for the hydraulic medium is formed axially between the annular piston (17) and a bottom (19) of the annular recess (18), said pressure chamber (20) being intersected by a duct (23) for the hydraulic medium, a supply of hydraulic medium to the duct (23) is accomplished by an electromagnetic switching valve (27) that is capable of being energized by a control unit (28) which cooperates with measuring means to determine an impact speed of the armature (4) on the opening and closing magnets (6, 5), when the impact speed of the armature (4) on the closing magnet (5) is higher, the control unit (28) energizes the switching valve (27) so that the duct (23) is connected to a tank connection (T) of the switching valve (27), when the impact speed of the armature (4) on the opening magnet (6) is higher, the control unit (28) energizes the switching valve (27) so that the duct (23) is connected to a pump connection (P) of the switching valve (270, and at a same impact speed of the armature (4) on the closing and the opening magnets (5, 6), the control unit (28) energizes the switching valve (27) so that the tank and the pump connections (T, P) are closed.

2. A valve drive according to claim 1, characterized in that the annular piston (17) is sealed radially inward and outward relative to the annular recess (18) by at least one sealing ring (22, 21).

3. A valve drive according to claim 1, characterized in that a section of the duct (23) extends through the closing magnet (5) and intersects the actuator rod (3), and an annular groove (25) extends on the outer peripheral surface (26) of the actuator rod (3) of the stem (9) and is aligned to the section of the duct (23) only when the armature (4) is in abutment with the closing magnet (5).

4. A value drive drive according to claim 1, characterized in that the energization of the switching value (27) by the control unit (28) is effected as a function of load or torque.

5. A valve drive according to claim 1, characterized in that the switching valve (27) is a 3/3 current-proportional valve.

6. A valve drive according to claim 1, characterized in that a hydraulic clearance compensation element (16) is arranged on one end (15) of the actuator rod (3) and acts directly on the gas exchange valve (2).

7. A valve drive according to claim 6, characterized in that the clearance compensation element (16) is supplied with hydraulic medium axially out of the actuator rod (3).

* * * * *